US009449753B2

(12) United States Patent
Kim et al.

(10) Patent No.: US 9,449,753 B2
(45) Date of Patent: Sep. 20, 2016

(54) VARYING THICKNESS INDUCTOR

(71) Applicant: QUALCOMM Incorporated, San Diego, CA (US)

(72) Inventors: Daeik Daniel Kim, San Diego, CA (US); Chengjie Zuo, Santee, CA (US); Changhan Hobie Yun, San Diego, CA (US); Mario Francisco Velez, San Diego, CA (US); Robert Paul Mikulka, Oceanside, CA (US); Xiangdong Zhang, Westford, MA (US); Jonghae Kim, San Diego, CA (US); Je-Hsiung Lan, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 14/155,244

(22) Filed: Jan. 14, 2014

(65) Prior Publication Data

US 2015/0061813 A1 Mar. 5, 2015

Related U.S. Application Data

(60) Provisional application No. 61/872,342, filed on Aug. 30, 2013.

(51) Int. Cl.
*H01F 5/00* (2006.01)
*H01F 27/29* (2006.01)
(Continued)

(52) U.S. Cl.
CPC ..... *H01F 27/2804* (2013.01); *H01F 17/0013* (2013.01); *H01F 41/042* (2013.01); *H01F 2017/0053* (2013.01); *H01F 2017/0073* (2013.01); *H01F 2027/2809* (2013.01)

(58) Field of Classification Search
CPC ..... H01F 17/0013; H01F 17/0006; H01F 27/2804; H01F 17/0033; H01F 2027/2809; H01F 41/042; H01F 17/0053; H01F 27/28; H01L 23/5227
USPC ..... 336/200, 192, 198, 83, 223, 183
See application file for complete search history.

(56) References Cited

U.S. PATENT DOCUMENTS 3,798,059 A 3/1974 Astle et al.
4,815,128 A 3/1989 Malek
(Continued)

FOREIGN PATENT DOCUMENTS

CN 102522181 A 6/2012
CN 203942319 U 11/2014
(Continued)

OTHER PUBLICATIONS

International Search Report and Written Opinion for International Application No. PCT/US2014/048723, ISA/EPO, Date of Mailing Oct. 20, 2014, 13 pages.
(Continued)

*Primary Examiner* — Mangtin Lian
*Assistant Examiner* — Kazi Hossain
(74) *Attorney, Agent, or Firm* — Toler Law Group, PC

(57) ABSTRACT

A particular device includes a substrate and a spiral inductor coupled to the substrate. The spiral inductor includes a first conductive spiral and a second conductive spiral overlaying the first conductive spiral. A first portion of an innermost turn of the spiral inductor has a first thickness in a direction perpendicular to the substrate. The first portion of the innermost turn includes a first portion of the first conductive spiral and does not include the second conductive spiral. A second portion of the innermost turn includes a first portion of the second conductive spiral. A portion of an outermost turn of the spiral inductor has a second thickness in the direction perpendicular to the substrate that is greater than the first thickness. A portion of the outermost turn includes a second portion of the first conductive spiral and a second portion of the second conductive spiral.

25 Claims, 7 Drawing Sheets

(51) Int. Cl.

| | |
|---|---|
| ***H01F 27/30*** | (2006.01) |
| ***H01F 27/28*** | (2006.01) |
| ***H01F 41/04*** | (2006.01) |
| ***H01F 17/00*** | (2006.01) |

(56) References Cited

U.S. PATENT DOCUMENTS 4,816,784 A 3/1989 Rabjohn
4,841,253 A 6/1989 Crabill
5,015,972 A 5/1991 Cygan et al.
5,038,104 A 8/1991 Wikswo, Jr. et al.
5,095,357 A 3/1992 Andoh et al.
5,111,169 A * 5/1992 Ikeda ..... H03H 7/427 333/181
5,161,082 A 11/1992 Alfonso
5,719,073 A 2/1998 Shaw et al.
5,831,331 A 11/1998 Lee
5,959,846 A 9/1999 Noguchi et al.
5,986,617 A 11/1999 McLellan
6,025,261 A 2/2000 Farrar et al.
6,169,470 B1 1/2001 Ibata et al.
6,429,763 B1 8/2002 Patel et al.
6,437,965 B1 8/2002 Adkins et al.
6,501,363 B1 12/2002 Hwu et al.
6,580,350 B1 6/2003 Kobayashi
6,603,382 B1 8/2003 Komai et al.
6,649,998 B2 11/2003 Song
6,714,112 B2 3/2004 Beng et al.
6,801,114 B2 10/2004 Yang et al.
6,816,784 B1 11/2004 Khan et al.
6,870,457 B2 3/2005 Chen et al.
6,985,035 B1 1/2006 Khorramabadi
7,064,411 B2 * 6/2006 Hashizume ..... H01F 17/0006 257/516
7,304,558 B1 12/2007 Pleskach et al.
7,312,685 B1 12/2007 Lee
7,370,403 B1 5/2008 Hsu et al.
7,486,168 B2 2/2009 Kim
7,526,256 B2 4/2009 Bhatti et al.
7,570,129 B2 8/2009 Kintis et al.
7,592,891 B2 9/2009 Hsu et al.
7,616,934 B2 11/2009 MacPhail
7,619,297 B2 11/2009 Wang
7,808,358 B2 10/2010 Nakamura et al.
7,894,205 B2 2/2011 Lee et al.
8,013,708 B2 9/2011 Tsai
8,045,946 B2 10/2011 Roo et al.
8,229,367 B2 7/2012 Chan et al.
8,233,870 B2 7/2012 Walley et al.
8,339,233 B2 12/2012 Tsai et al.
8,354,325 B1 1/2013 Dao et al.
8,368,481 B2 2/2013 Jin et al.
8,493,126 B2 7/2013 Sankaranarayanan et al.
8,591,262 B2 11/2013 Schaffer et al.
9,001,031 B2 4/2015 Lo et al.
2002/0057176 A1 * 5/2002 Norstrom ..... H01F 41/041 336/200
2002/0113682 A1 8/2002 Gevorgian et al.
2002/0132383 A1 9/2002 Hiroki et al.
2003/0151485 A1 8/2003 Lewis
2004/0012474 A1 1/2004 Hwu et al.
2004/0090298 A1 * 5/2004 Masu ..... H01F 17/0006 336/200
2004/0150502 A1 8/2004 Jacobson et al.
2004/0207504 A1 10/2004 Yang et al.
2005/0104158 A1 5/2005 Bhattacharjee et al.
2006/0017539 A1 1/2006 Lee et al.
2006/0284719 A1 12/2006 Lee
2007/0008058 A1 1/2007 Hashimoto
2007/0030116 A1 2/2007 Feher
2007/0152298 A1 7/2007 Kim
2007/0176845 A1 8/2007 Yamazaki et al.
2007/0188997 A1 8/2007 Hockanson et al.
2007/0247269 A1 10/2007 Papananos
2007/0249078 A1 10/2007 Tung et al.
2008/0037590 A1 2/2008 Aiga et al.
2008/0076354 A1 3/2008 Rofougaran
2008/0157913 A1 * 7/2008 Kim ..... H01F 17/0013 336/200
2008/0169895 A1 7/2008 Lee
2008/0174396 A1 7/2008 Choi et al.
2008/0174397 A1 * 7/2008 de Rooij ..... G01R 33/34 336/200
2008/0246114 A1 10/2008 Abrokwah et al.
2008/0272875 A1 11/2008 Huang et al.
2008/0303622 A1 12/2008 Park et al.
2009/0001510 A1 1/2009 Matz et al.
2009/0085708 A1 * 4/2009 Matsumoto ..... H01F 17/0013 336/200
2009/0146770 A1 6/2009 Lee et al.
2009/0243389 A1 10/2009 Edo et al.
2009/0243749 A1 10/2009 Rofougaran
2009/0322447 A1 * 12/2009 Daley ..... H01L 23/5223 333/185
2010/0060402 A1 3/2010 Chen
2010/0096753 A1 4/2010 Hwang et al.
2010/0109123 A1 * 5/2010 Strzalkowski ..... H01F 17/0013 257/531
2010/0148866 A1 6/2010 Lee et al.
2010/0164667 A1 7/2010 Ho-Hsiang
2010/0182118 A1 7/2010 Roskos et al.
2010/0225435 A1 9/2010 Li et al.
2010/0231305 A1 9/2010 Mizokami et al.
2010/0270947 A1 10/2010 Chang et al.
2011/0018670 A1 1/2011 Bae et al.
2011/0050357 A1 3/2011 Kim et al.
2011/0102124 A1 * 5/2011 Matsushita ..... H01F 17/0013 336/200
2011/0133875 A1 * 6/2011 Chiu ..... H01F 17/0013 336/200
2011/0133879 A1 * 6/2011 Chiu ..... H01F 17/0013 336/200
2011/0168997 A1 7/2011 Lee et al.
2011/0217657 A1 9/2011 Flemming et al.
2011/0221560 A1 9/2011 Chen et al.
2011/0229667 A1 9/2011 Jin et al.
2011/0229687 A1 9/2011 Gu et al.
2011/0245948 A1 10/2011 Bai et al.
2011/0291786 A1 12/2011 Li et al.
2011/0299435 A1 12/2011 Mikhemar et al.
2011/0304013 A1 12/2011 Chen et al.
2012/0075216 A1 3/2012 Black et al.
2012/0146741 A1 6/2012 Yen et al.
2012/0188047 A1 7/2012 Groves et al.
2012/0194403 A1 8/2012 Cordier et al.
2012/0235779 A1 * 9/2012 Baram ..... H01F 5/003 336/200
2012/0235969 A1 9/2012 Burns et al.
2012/0238331 A1 9/2012 Dou et al.
2012/0244802 A1 9/2012 Feng et al.
2012/0249186 A1 10/2012 Chen
2012/0249281 A1 * 10/2012 Campbell ..... G01N 27/9006 336/200
2012/0293485 A1 11/2012 Chang et al.
2012/0299166 A1 11/2012 Minamio et al.
2013/0016633 A1 1/2013 Lum et al.
2013/0039229 A1 2/2013 Park et al.
2013/0050226 A1 2/2013 Shenoy et al.
2013/0057343 A1 3/2013 Kondo
2013/0106554 A1 * 5/2013 Girard ..... H01F 5/003 336/200
2013/0207276 A1 8/2013 Tseng et al.
2013/0207739 A1 8/2013 Bakalski
2013/0207745 A1 8/2013 Yun et al.
2013/0257367 A1 10/2013 Someya
2013/0278374 A1 10/2013 Thorslund
2014/0138792 A1 5/2014 Lo et al.
2014/0145810 A1 5/2014 Park et al.
2014/0197902 A1 7/2014 Zuo et al.
2014/0225702 A1 * 8/2014 Yazaki ..... H01F 17/0013 336/200
2014/0227982 A1 8/2014 Granger-Jones et al.
2014/0240072 A1 8/2014 Lan et al.
2014/0266494 A1 9/2014 Lan et al.

(56) References Cited

U.S. PATENT DOCUMENTS

| | | | |
|---|---|---|---|
| 2014/0293841 | A1 | 10/2014 | Rousu |
| 2014/0327510 | A1 | 11/2014 | Kim et al. |
| 2015/0092314 | A1 | 4/2015 | Kim |
| 2015/0130579 | A1 | 5/2015 | Kim et al. |
| 2015/0194944 | A1 | 7/2015 | Joshi et al. |
| 2015/0304059 | A1 | 10/2015 | Zuo |

FOREIGN PATENT DOCUMENTS

| | | | |
|---|---|---|---|
| EP | 0468757 | A2 | 1/1992 |
| EP | 0995264 | A1 | 4/2000 |
| EP | 1085538 | A1 | 3/2001 |
| EP | 1729413 | A1 | 12/2006 |
| JP | 2002152901 | A | 5/2002 |
| JP | 2005032976 | A | 2/2005 |
| KR | 101127478 | B1 | 3/2012 |
| KR | 20130072284 | A | 7/2013 |
| KR | 20130098099 | A | 9/2013 |
| WO | 02080279 | A1 | 10/2002 |

OTHER PUBLICATIONS

Chen, C.-H., et al., "Very Compact Transformer-Coupled Balun-Integrated Bandpass Filter Using Integrated Passive Device Technology on Glass Substrate," Microwave Symposium Digest (MTT), 2010 IEEE MTT-S International, May 2010, IEEE, Piscataway, NJ, pp. 1372-1375.

Fu, J.-S., et al., "A Ferroelectric-Based Impedance Tuner for Adaptive Matching Applications," Microwave Symposium Digest, 2008 IEEE MTT-S International, Jun. 2008, IEEE, Piscataway, NJ, pp. 955-958.

Mikhemar, M., et al., "An On-Chip Wideband and Low-Loss Duplexer for 3G/4G CMOS Radios," IEEE Symposium on VLSI Circuits, Jun. 2010, IEEE, Piscataway, NJ, pp. 129-130.

Mikhemar, M., et al., "A Tunable Integrated Duplexer with 50dB Isolation in 40nm CMOS," IEEE International Solid-State Circuits Conference, Feb. 2009, IEEE, Piscataway, NJ, pp. 386-387, 387a.

Mobley, T., et al., "Through Glass Via (TGV) Solutions for Wafer and Chip Level Interposers and RF Integration Methods for High Frequency Applications," Mar. 2012, nMode Solutions, Tucson, Arizona, 25 pages.

Orlandi, S., et al., "Optimization of shielded PCB air-core toroids for high efficiency dc-dc converters," Energy Conversion Congress and Exposition, Sep. 2009, IEEE, Piscataway, NJ, pp. 2073-2080.

Shorey, A., et al., "Development of Substrates Featuring Through Glass Vias (TGV) for 3D-IC Integration," Corning Incorporated, 2010, Corning, New York, pp. 1-3.

Töpper, M., et al., "3-D Film Interposer Based on TGV (Through Glass Vias): An Alternative to Si-Interposer," 2010 Electronic Components and Technology Conference, Jun. 2010, IEEE, Piscataway, NJ, pp. 66-73.

Yoon, Y. et al., "Design and Characterization of Multilayer Spiral Transmission-Line Baluns," IEEE Transactions on Microwave Theory and Techniques, Sep. 1999, vol. 47, No. 9, IEEE, Piscataway, NJ, pp. 1841-1847.

Yu, X., et al., "Silicon-Embedding Approaches to 3-D Toroidal Inductor Fabrication," Journal of Microelectromechanical Systems, Jun. 2013, vol. 22, No. 3, IEEE, Piscataway, NJ, pp. 580-588.

Bae, H., et al., "Extraction of Separated Source and Drain Resistances in Amorphous Indium—Gallium—Zinc Oxide TFTs Through C—V Characterization," IEEE Electron Device Letters, Jun. 2011, vol. 32, No. 6, IEEE, Piscataway, NJ, pp. 761-763.

Saputra, N., et al., "Single-Grain Si Thin-Film Transistors for Analog and RF Circuit Applications," Solid State Device Research Conference, 2007. ESSDERC. 37th European, Sep. 2007, IEEE, Piscataway, NJ, pp. 107-110.

* cited by examiner

306

| | L (nH) | Q | Area ($mm^2$) | Q/Area |
|---|---|---|---|---|
| Nonvarying | 4.9851 | 32.974 | 0.575 | 57.4 |
| Varying | 4.9851 | 33.775 | 0.571 | 59.2 |
| Change | 0.00% | 2.43% | -0.72% | 3.17% |

VARYING THICKNESS INDUCTOR

I. CLAIM OF PRIORITY

The present application claims priority from U.S. Provisional Patent Application No. 61/872,342, entitled "VARYING THICKNESS INDUCTOR," filed Aug. 30, 2013, the contents of which are incorporated by reference in their entirety.

II. FIELD

The present disclosure is generally related to an inductor having a thickness that varies.

III. DESCRIPTION OF RELATED ART

Advances in technology have resulted in smaller and more powerful computing devices. For example, there currently exist a variety of portable personal computing devices, including wireless computing devices, such as portable wireless telephones, personal digital assistants (PDAs), and paging devices that are small, lightweight, and easily carried by users. More specifically, portable wireless telephones, such as cellular telephones and internet protocol (IP) telephones, can communicate voice and data packets over wireless networks. Further, many such wireless telephones include other types of devices that are incorporated therein. For example, a wireless telephone can also include a digital still camera, a digital video camera, a digital recorder, and an audio file player. Also, such wireless telephones can process executable instructions, including software applications, such as a web browser application, that can be used to access the Internet. As such, these wireless telephones can include significant computing capabilities.

Inductors are used in power regulation, frequency control and signal conditioning applications in many electronic devices (e.g., personal computers, tablet computers, wireless mobile handsets, and wireless telephones). An inductor with a higher electrical resistance may consume more power than an inductor with a lower electrical resistance. A spiral inductor may contribute a particular electrical resistance (e.g., a resistance associated with an eddy current loss) to an electrical system powered by an alternating current. The eddy current loss may be related to a quantity or a volume of conductive material present in an innermost turn of the spiral inductor. A trace width associated with the spiral inductor may be decreased to reduce the eddy current loss. However, process technology used to fabricate the spiral inductor may be unable to produce an inductor with a trace width smaller than a particular width.

IV. SUMMARY

This disclosure presents embodiments of an inductor having a thickness that varies. The inductor may be a stepped layer stack spiral inductor or a gradient layer stack spiral inductor. For example, the inductor may be coupled to a substrate and a portion of an outermost turn of the inductor may be thicker than a portion of an innermost turn of the inductor. In the example, the thickness of the inductor may monotonically increase (e.g., consistently increasing without substantially decreasing) from the innermost turn of the inductor to the outermost turn of the inductor. The inductor may be configured to provide a similar inductance value as compared to a conventional spiral inductor of similar size (e.g., a spiral inductor having a uniform thickness). The reduced thickness of the innermost turn may cause the inductor to have a lower radio frequency (RF) resistance than the conventional spiral inductor due to reduced eddy current loss. An electronic device may use the inductor to provide inductance using less power, as compared to an electronic device that includes the conventional spiral inductor.

In a particular embodiment, an apparatus includes a substrate and a spiral inductor coupled to the substrate. The spiral inductor includes a first conductive spiral and a second conductive spiral overlaying the first conductive spiral. A first portion of an innermost turn of the spiral inductor has a first thickness in a direction perpendicular to the substrate. The first portion of the innermost turn includes a first portion of the first conductive spiral and does not include the second conductive spiral. A second portion of the innermost turn includes a first portion of the second conductive spiral. A portion of an outermost turn of the spiral inductor has a second thickness, in the direction perpendicular to the substrate, that is greater than the first thickness. A portion of the outermost turn includes a second portion of the first conductive spiral and a second portion of the second conductive spiral.

In another particular embodiment, a method includes forming a first conductive spiral of a spiral inductor coupled to a substrate. The method further includes forming a second conductive spiral of the spiral inductor that overlays the first conductive spiral. A first portion of an innermost turn of the spiral inductor has a first thickness in a direction perpendicular to the substrate. The first portion of the innermost turn includes a first portion of the first conductive spiral and does not include the second conductive spiral. A second portion of the innermost turn includes a first portion of the second conductive spiral. A portion of an outermost turn of the spiral inductor has a second thickness in the direction perpendicular to the substrate. The second thickness is greater than the first thickness. The portion of the outermost turn includes a second portion of the first conductive spiral and a second portion of the second conductive spiral.

In another particular embodiment, an apparatus includes a substrate and a spiral inductor coupled to the substrate. A first portion of an innermost turn of the spiral inductor has a first thickness in a direction perpendicular to the substrate. A second portion of the innermost turn of the spiral inductor has a second thickness in the direction perpendicular to the substrate. The second thickness is greater than the first thickness. A thickness of the spiral inductor in the direction perpendicular to the substrate increases according to a gradient from the first thickness to the second thickness.

In another particular embodiment, a method includes forming a conductive spiral of a spiral inductor coupled to a substrate. The method further includes forming a conductive layer of the spiral inductor above the conductive spiral. A first portion of an innermost turn of the spiral inductor has a first thickness in a direction perpendicular to the substrate. A second portion of the innermost turn has a second thickness in the direction perpendicular to the substrate. The second thickness is greater than the first thickness. A thickness of the spiral inductor in the direction perpendicular to the substrate increases according to a gradient from the first thickness to the second thickness.

One particular advantage provided by at least one of the disclosed embodiments is that a spiral inductor having a varying thickness provides a similar inductance as compared to a uniform thickness spiral inductor of similar dimensions. However, a reduced thickness of an innermost turn of the spiral inductor causes the inductor to have a lower electrical resistance due to a reduced eddy current loss. Thus, an electronic device may use the inductor having the varying thickness to provide inductance using less power, as compared to an electronic device that includes the uniform thickness spiral inductor.

Other aspects, advantages, and features of the present disclosure will become apparent after review of the entire application, including the following sections: Brief Description of the Drawings, Detailed Description, and the Claims.

V. BRIEF DESCRIPTION OF THE DRAWINGS

VI. DETAILED DESCRIPTION

Figure 1:
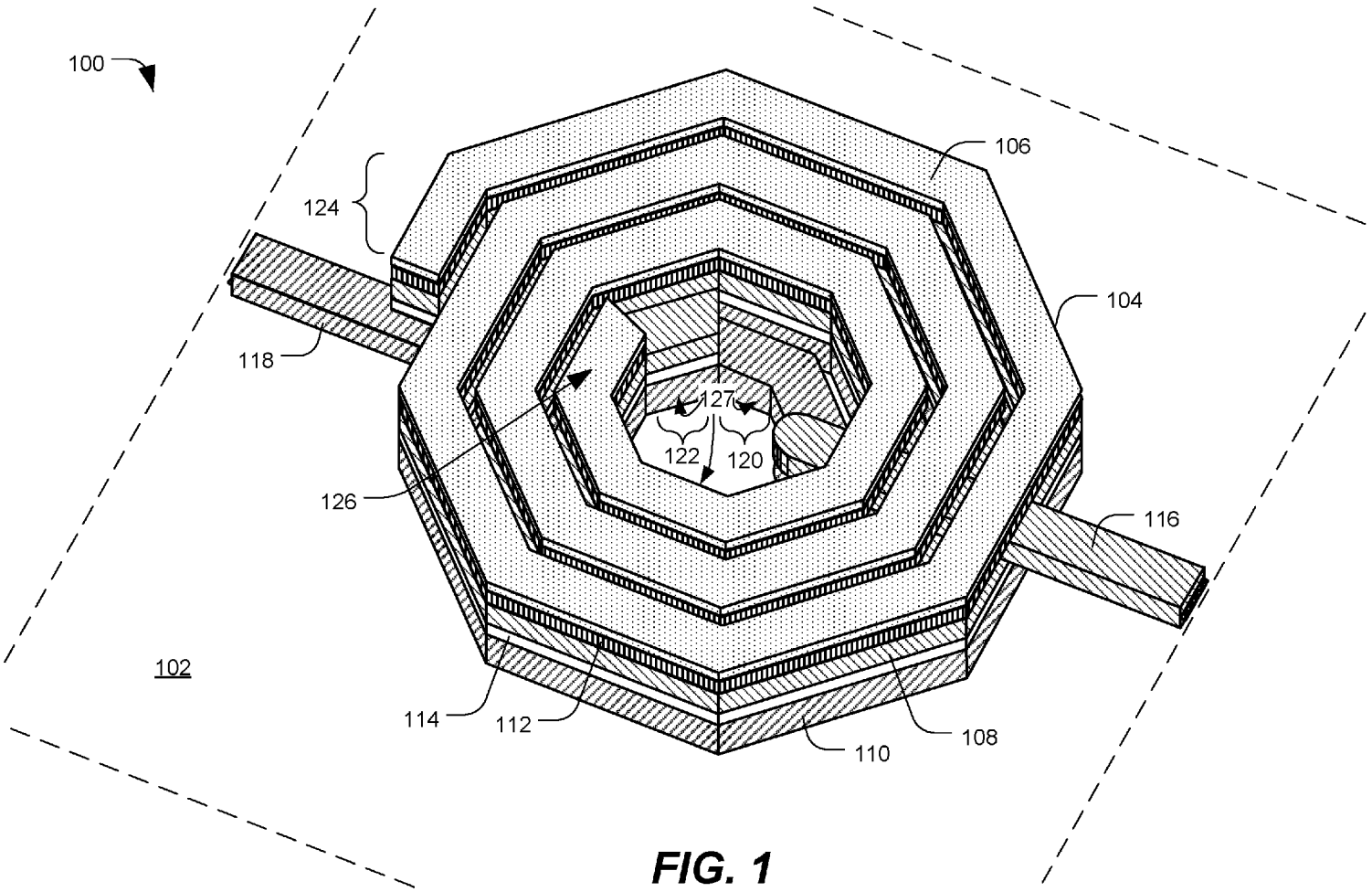
FIG. 1 is a diagram depicting a particular embodiment of a system including a substrate and a stepped layer stack spiral inductor having a thickness that varies.

Referring to FIG. 1, a particular illustrative embodiment of a system 100 including a substrate 102 and a spiral inductor 104 (e.g., a stepped layer stack inductor) coupled to the substrate 102 is shown. The spiral inductor 104 may include a first conductive spiral 106, a conductive layer 108, a second conductive spiral 110, a first passivation layer 112, and a second passivation layer 114. The spiral inductor 104 is connected to a first lead 116 and to a second lead 118. A trace width associated with the spiral inductor 104 may be a minimum trace width that can be manufactured using a particular process technology used to fabricate the spiral inductor 104. In a particular embodiment, the spiral inductor includes a layer with a thickness between 1 μm and 20 μm having a minimum trace width between 5 μm and 50 μm.

The conductive layer 108 may form a spiral (e.g., a conductive spiral) or may form a partial spiral or a discontinuous spiral (e.g., the conductive layer 108 may form a spiral shape, but the conductive layer 108 may not be present within a particular distance from the first lead 116 and from the second lead 118). A spiral may include a plurality of turns, where each beginning point of each turn has a different radius from a center point of the spiral.

The spiral inductor 104 includes a first portion 120 having a first thickness in a direction perpendicular to the substrate 102, a second portion 122 having a second thickness in the direction perpendicular to the substrate 102, a third portion 126 having a third thickness in the direction perpendicular to the substrate 102, and a fourth portion 124 having a fourth thickness in the direction perpendicular to the substrate 102. The fourth thickness may be greater than the third thickness (not shown), the third thickness may be greater than the second thickness, and the second thickness may be greater than the first thickness. The first portion 120, the second portion 122, and the third portion 126 may be part of an innermost turn 127 of the spiral inductor 104 and the fourth portion 124 may be part of an outermost turn of the spiral inductor 104. In a particular embodiment, the first portion 120 includes a first portion of the second conductive spiral 110. The second portion 122 may include a first portion of the conductive layer 108 and a second portion of the second conductive spiral 110. The third portion 126 may include a first portion of the first conductive spiral 106, a second portion of the conductive layer 108, and a third portion of the second conductive spiral 110. The fourth portion 124 may include a second portion of the first conductive spiral 106, a third portion of the conductive layer 108, and a fourth portion of the second conductive spiral 110.

Although FIG. 1 illustrates each spiral having a different length, in other embodiments, two or more spirals may have the same length. Although FIG. 1 illustrates the first portion 120, the second portion 122, and the third portion 126 as each having a different thickness, in other embodiments, the second thickness may be the same as the first thickness or the third thickness. Further, although FIG. 1 illustrates the third length of the second conductive spiral 110 being greater than the second length of the conductive layer 108 and the second length of the conductive layer 108 being greater than the first length of the first conductive spiral 106, in other embodiments, the conductive spirals and the conductive layer may have a different length relationship (e.g., the first length of the first conductive spiral 106 may be greater than the second length of the conductive layer 108 and the second length of the conductive layer 108 may be greater than the third length of the second conductive spiral 110). Thus, although FIG. 1 illustrates the first portion 120 including only the first portion of the second conductive spiral 110, in other embodiments, the first portion 120 may include portions of different conductive spirals or a portion of the conductive layer. For example, the first portion 120 may include only a first portion of the first conductive spiral 106.

The substrate 102 may be a dielectric substrate formed of a glass material, an alkaline earth boro-aluminosilicate glass, Silicon (Si), Gallium Arsenide (GaAs), Indium Phosphate (InP), Silicon Carbide (SiC), a glass-based laminate, sapphire ($Al_2O_3$), quartz, a ceramic, Silicon on Insulator (SOI), Silicon on Sapphire (SOS), high resistivity Silicon (HRS), Aluminum Nitride (AlN), a plastic, or a combination thereof. The conductive spirals 106 and 110 and the conductive layer 108 may be formed by depositing aluminum, copper, silver, gold, tungsten, molybdenum, an alloy of aluminum, silver, gold, tungsten, or molybdenum, or a combination thereof, above the substrate 102. The spiral inductor 104 may be fabricated using the same fabrication steps as an inductor having an outermost turn having a thickness that is not greater than a thickness of an innermost turn (e.g., additional deposition steps or etching steps may be unnecessary). Each passivation layer (e.g., the first passivation layer 112 and the second passivation layer 114) may be formed of a photo-definable polymer.

In a particular embodiment, the first conductive spiral 106 overlays the conductive layer 108 and the conductive layer 108 overlays the second conductive spiral 110. The first passivation layer 112 may be formed between the first conductive spiral 106 and the conductive layer 108. The second passivation layer 114 may be formed between the conductive layer 108 and the second conductive spiral 110. One or more vias may be formed in the first passivation layer 112, the second passivation layer 114, or both. The one or more vias may electrically connect the first conductive spiral 106, the conductive layer 108, and the second conductive spiral 110, or a combination thereof. The one or more vias may further electrically connect the first conductive spiral 106, the conductive layer 108, the second conductive spiral 110, or a combination thereof, to the first lead 116, to the second lead 118, or to both.

A thickness of the spiral inductor 104 in the direction perpendicular to the substrate 102 may increase monotonically from an innermost portion of the spiral inductor 104 to an outermost portion of the spiral inductor 104. In a particular embodiment, the spiral inductor 104 may be a stepped layer stack inductor where a thickness of the spiral inductor 104 in the direction perpendicular to the substrate 102 increases in a step configuration. For example, a thickness of the first conductive spiral 106, the conductive layer 108, and the second conductive spiral 110 in the direction perpendicular to the substrate 102 may be substantially constant along the length of each conductive spiral. In this example, a second length of the conductive layer 108 may be greater than a first length of the first conductive spiral 106 and a third length of the second conductive spiral 110 may be greater than a second length of the conductive layer 108. The first portion 120 may include a first portion of the second conductive spiral 110. The first conductive spiral 106 and the conductive layer 108 may not extend to the first portion 120. The second portion 122 may include a second portion of the second conductive spiral 110 and a first portion of the conductive layer 108. The first conductive spiral 106 may not extend to the second portion 122. The fourth portion 124 may include a third portion of the second conductive spiral 110, a second portion of the conductive layer 108, and a portion of the first conductive spiral 106. As another example, the first conductive spiral 106 may be formed by depositing a first conductive layer with a first length and by depositing a second conductive layer with a second length directly above (e.g., with no intervening passivation layer) the first conductive layer. The first conductive layer and the second conductive layer may have different lengths.

When a current is applied to the first lead 116 or the second lead 118, a magnetic field is generated by the spiral inductor 104. An eddy current loss associated with the outermost turn of the spiral inductor 104 may be reduced, as compared to a uniform thickness spiral inductor, because the outermost turn of the spiral inductor 104 has a greater thickness than the innermost turn of the spiral inductor (i.e., because a conductive volume of the innermost turn of the spiral inductor 104 is smaller than a conductive volume of an innermost turn of the uniform thickness spiral inductor). Thus, a radio frequency (RF) resistance associated with the spiral inductor 104 may be reduced because eddy current loss contributes to RF resistance.

Although FIG. 1 illustrates the spiral inductor 104 including two conductive spirals, in other embodiments, the spiral inductor 104 may include one conductive spiral or more than two conductive spirals. Although FIG. 1 illustrates the spiral inductor 104 including one conductive layer, in other embodiments, the spiral inductor 104 may include more than one conductive layer. Although FIG. 1 illustrates the first passivation layer 112 and the second passivation layer 114 as overlaying the conductive layer 108 and the second conductive spiral 110 respectively, the first passivation layer 112, the second passivation layer 114, or both, may cover an area larger than an area associated with the spiral inductor 104 (e.g., the first passivation layer 112, the second passivation layer 114, or both, may fill a center of the spiral inductor 104 or the space between turns of the spiral inductor 104).

An electronic device that includes a varying thickness spiral inductor (e.g., the spiral inductor 104) may provide a similar inductance as compared to a uniform thickness spiral inductor of similar dimensions. However, a reduced thickness of an innermost turn of the varying thickness spiral inductor causes the varying thickness inductor to have a lower electrical resistance to an alternating current due to reduced eddy current loss. Thus, an electronic device may use the varying thickness inductor to provide inductance using less RF power, as compared to an electronic device that includes the uniform thickness spiral inductor.

Figure 2:
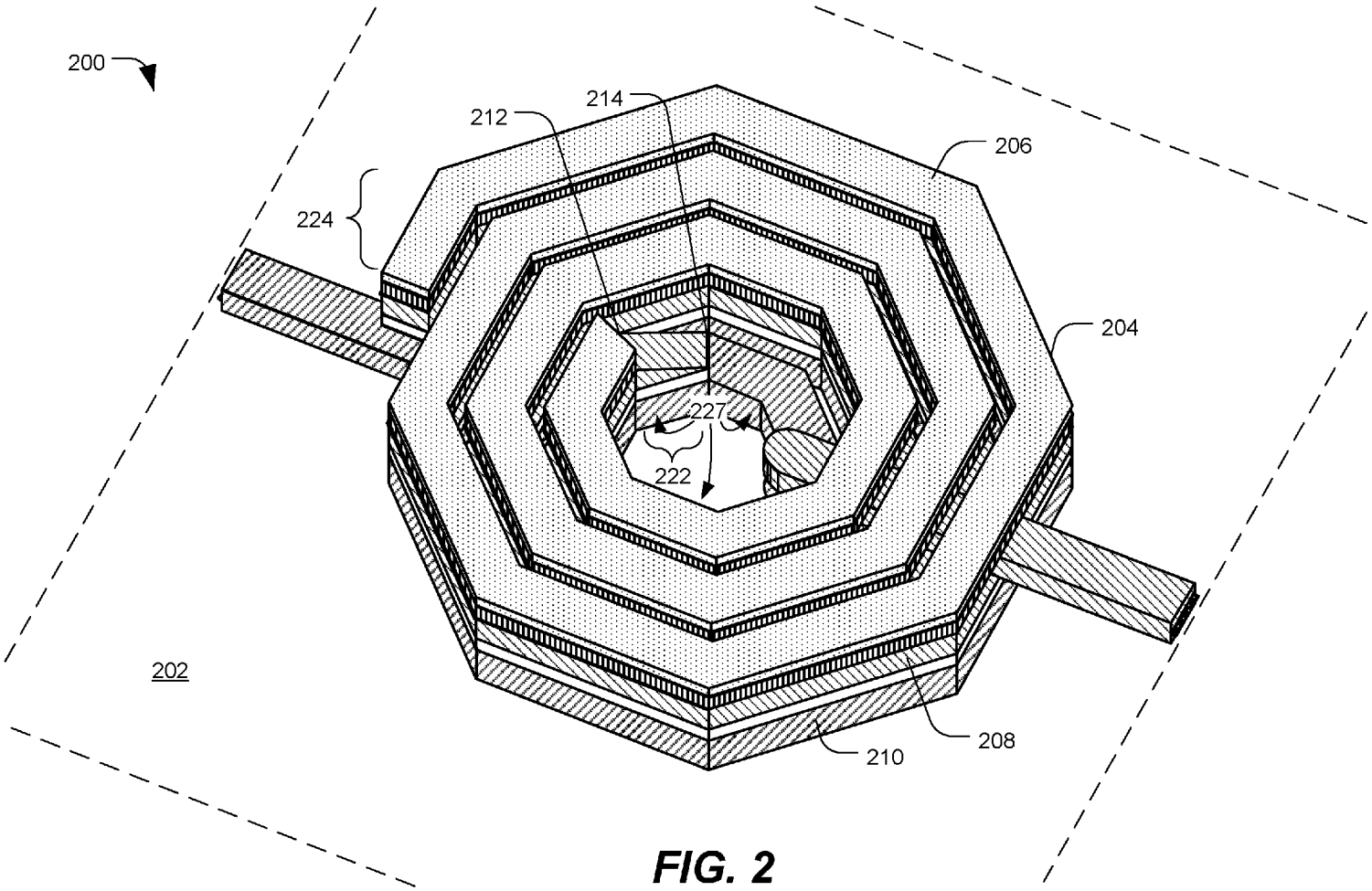
FIG. 2 is a diagram depicting a particular embodiment of a system including a substrate and a gradient layer stack spiral inductor having a thickness that varies.

Referring to FIG. 2, a particular illustrative embodiment of a system 200 including a substrate 202 and a spiral inductor 204 (e.g., a gradient layer stack inductor) coupled to the substrate 202 is shown. The spiral inductor 204 may include a first conductive spiral 206, a conductive layer 208, and a second conductive spiral 210. A trace width associated with the spiral inductor 204 may be a minimum trace width that can be manufactured using a particular process technology used to fabricate the spiral inductor 204. The system 200 may be the same as the system 100, except one or more of the first conductive spiral 206, the conductive layer 208, the second conductive spiral 210 of the spiral inductor 204 may have a gradient thickness, as described below, as compared to a thickness that increases in the step configuration of FIG. 1. The system 200 may be fabricated using similar methods and materials as the system 100 of FIG. 1.

A thickness of the spiral inductor 204 in the direction perpendicular to the substrate 202 may increase monotonically from an innermost portion of the spiral inductor 204 to an outermost portion of the spiral inductor 204. In a particular embodiment, the spiral inductor 204 may be a gradient layer stack inductor where a thickness in the direction perpendicular to the substrate 202 increases from one point along an innermost turn 227 to another point along the innermost turn 227. The thickness of a first portion of an innermost turn 227 of the spiral inductor 204 may be greater than a thickness of a second portion of the innermost turn 227. For example, a particular portion of the conductive layer 208 corresponding to a portion 222 of the innermost turn 227 of the spiral inductor 204 may have a gradient thickness (e.g., a thickness that varies proportionately to an incline along a portion 222 of the innermost turn 227 of the spiral inductor 204) in the direction perpendicular to the substrate 202. A portion of the conductive layer 208 corresponding to the portion 222 may have a thickness in the direction perpendicular to the substrate 202 that increases from a first point 214 to a second point 212. A portion of the conductive layer 208 corresponding to the second point 212 may have a thickness in the direction perpendicular to the substrate 202 that is greater than a thickness of the first point 214. The first conductive spiral 106, the conductive layer 208, the second conductive spiral 110, or a combination thereof, may have a substantially constant thickness or may have a gradient thickness.

An electronic device that includes a varying thickness spiral inductor (e.g., the spiral inductor 204) may provide a similar inductance as compared to a uniform thickness spiral inductor of similar dimensions. However, a reduced thickness of an innermost turn of the varying thickness spiral inductor causes the varying thickness spiral inductor to have a lower electrical resistance due to reduced eddy current loss. Thus, an electronic device may use the varying thickness spiral inductor to provide inductance using less power, as compared to an electronic device that includes the uniform thickness spiral inductor.

Figure 3:
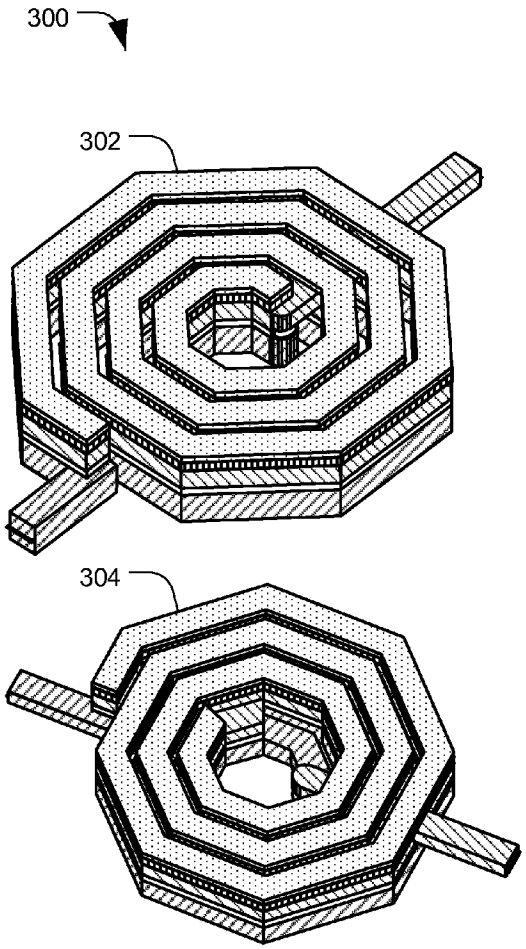
FIG. 3 is a diagram depicting a comparison between a spiral inductor having a thickness that varies and a spiral inductor having a thickness that does not vary.

Referring to FIG. 3, an illustrative diagram 300 of a comparison between a spiral inductor having a thickness that varies (e.g., a varying thickness spiral inductor 304), such as the spiral inductor 104 of FIG. 1 or the spiral inductor 204 of FIG. 2, and a spiral inductor having a thickness that does not vary (e.g., a uniform thickness spiral inductor 302). In FIG. 3, a table 306 illustrates a percent change between the uniform (e.g., nonvarying) thickness spiral inductor 302 and the varying thickness spiral inductor 304, in a particular embodiment where the uniform thickness spiral inductor 302 and the varying thickness spiral inductor 304 are proportioned to have an inductance value (L) of 4.9851 nanohenries (nH). A quality factor (Q) associated with the varying thickness spiral inductor 304 is higher (e.g., 33.775) than a quality factor associated with the uniform thickness spiral inductor 302 (e.g., 32.974) (e.g., 2.43% in the particular embodiment shown). The varying thickness spiral inductor 304 may be associated with a lower electrical resistance as compared to the uniform thickness spiral inductor 302, and for an inductor, electrical resistance is inversely proportional to quality factor. In addition, an area (in square millimeters ($mm^2$)) of the varying thickness spiral inductor 304 (e.g., 0.571 $mm^2$) used to generate the inductance value (e.g., 4.9851 nH) is smaller than an area of the uniform thickness spiral inductor 302 (e.g., 0.575 $mm^2$) used to generate the inductance value (e.g., 0.72% in the particular embodiment shown). A quality factor per area (Q/Area) of the varying thickness spiral inductor 304 (e.g., 59.2) is higher than a quality factor per area of the uniform thickness spiral inductor 302 (e.g., 3.17% in the particular embodiment shown).

Figure 4:
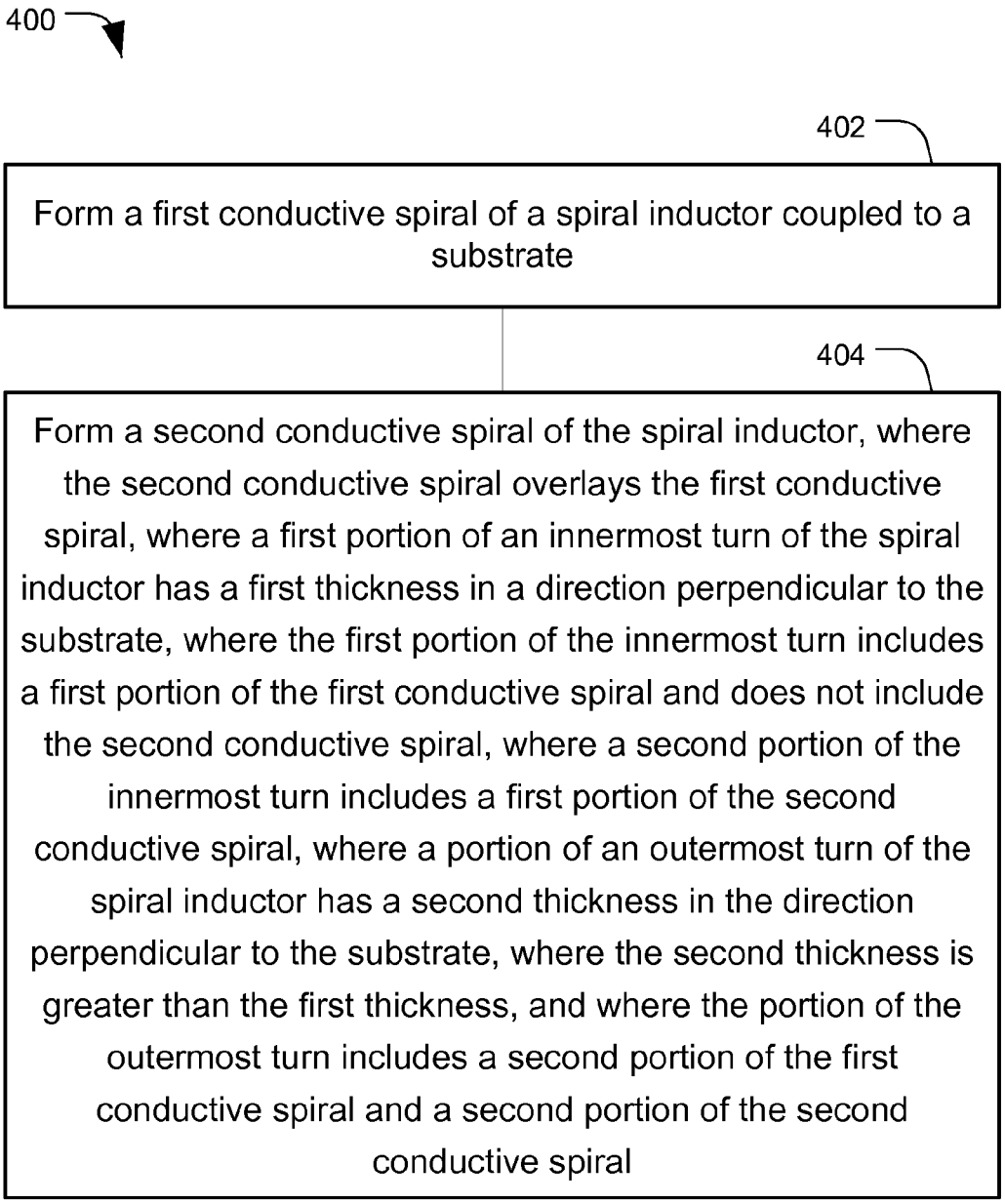
FIG. 4 is a flow chart that illustrates a particular embodiment of a method of forming a spiral inductor having a thickness that varies.

FIG. 4 is a flowchart illustrating a particular embodiment of a method 400 of forming an electronic device. The method includes, at 402, forming a first conductive spiral of a spiral inductor coupled to a substrate. For example, the second conductive spiral 110 of the spiral inductor 104 of FIG. 1 may be formed coupled to the substrate 102. The method further includes, at 404, forming a second conductive spiral of the spiral inductor. For example, the first conductive spiral 106 of the spiral inductor 104 of FIG. 1 may be formed. The second conductive spiral overlays the first conductive spiral. For example, the first conductive spiral 106 overlays the second conductive spiral 110. A first portion of an innermost turn of the spiral inductor has a first thickness in a direction perpendicular to the substrate. For example, the first portion 120 of the spiral inductor 104 of FIG. 1 has a first thickness in a direction perpendicular to the substrate 102. The first portion of the innermost turn includes a first portion of the first conductive spiral and does not include the second conductive spiral. For example, the first portion 120 of the spiral inductor 104 of FIG. 1 includes a portion of the second conductive spiral 110 and does not include the first conductive spiral 106. A second portion of the innermost turn includes a first portion of the second conductive spiral. For example, the third portion 126 of the spiral inductor 104 of FIG. 1 includes a portion of the first conductive spiral 106. A portion of an outermost turn of the spiral inductor has a second thickness in the direction perpendicular to the substrate, where the second thickness is greater than the first thickness. For example, the fourth portion 124 of the spiral inductor 104 of FIG. 1 has a second thickness in a direction perpendicular to the substrate 102, and the second thickness is greater than the first thickness. The portion of the outermost turn includes a second portion of the first conductive spiral and a second portion of the second conductive spiral. For example, the fourth portion 124 includes a portion of the second conductive spiral 110 and a portion of the first conductive spiral 106.

The method of FIG. 4 may be initiated by a processing unit such as a central processing unit (CPU), a field-programmable gate array (FPGA) device, an application-specific integrated circuit (ASIC), a controller, another hardware device, firmware device, or any combination thereof. As an example, the method of FIG. 4 can be initiated by fabrication equipment, such as a processor within or coupled to fabrication equipment and that executes instructions stored at a memory (e.g., a non-transitory computer-readable medium), as described further with reference to FIG. 7. Integrated circuit manufacturing processes may be used to fabricate the system 100 of FIG. 1 and the system 200 of FIG. 2, such as wet etching, dry etching, deposition, planarization, lithography, or a combination thereof.

An electronic device formed according to the method 400 may include a varying thickness spiral inductor that provides a similar inductance as compared to a uniform thickness spiral inductor of similar dimensions. However, a reduced thickness of an innermost turn of the varying thickness spiral inductor causes the varying thickness inductor to have a lower electrical resistance due to reduced eddy current loss. Thus, an electronic device may use the varying thickness inductor to provide inductance using less power, as compared to an electronic device that includes the uniform thickness spiral inductor.

Figure 5:
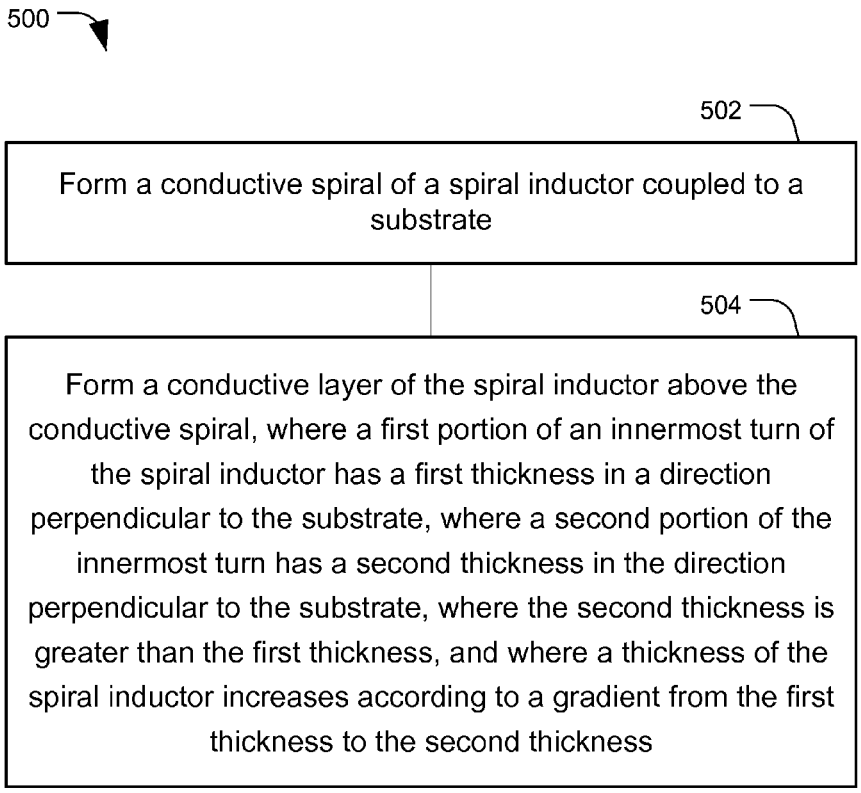
FIG. 5 is a flow chart that illustrates another particular embodiment of a method of forming a spiral inductor having a thickness that varies.

FIG. 5 is a flowchart illustrating a particular embodiment of a method 500 of forming an electronic device. The method includes, at 502, forming a conductive spiral of a spiral inductor coupled to a substrate. For example, the second conductive spiral 210 of the spiral inductor 204 of FIG. 2 may be formed and coupled to the substrate 202. The method further includes, at 504, forming a conductive layer of the spiral inductor above the conductive spiral. For example, the conductive layer 208 of the spiral inductor 204 of FIG. 2 may be formed above the second conductive spiral 210. A first portion of an innermost turn of the spiral inductor has a first thickness in a direction perpendicular to the substrate. For example, the portion of the spiral inductor 204 of FIG. 2 corresponding to the first point 214 has a first thickness in a direction perpendicular to the substrate 202. A second portion of the innermost turn has a second thickness in the direction perpendicular to the substrate, where the second thickness is greater than the first thickness. For example, the portion of the spiral inductor 204 of FIG. 2 corresponding to the second point 212 has a second thickness in a direction perpendicular to the substrate 202, and the second thickness is greater than the first thickness. A thickness of the spiral inductor in the direction perpendicular to the substrate increases according to a gradient from the first thickness to the second thickness. For example, the thickness of the spiral inductor 204 of FIG. 2 increases according to a gradient from the first point 214 to the second point 212.

The method of FIG. 5 may be initiated by a processing unit such as a central processing unit (CPU), a field-programmable gate array (FPGA) device, an application-specific integrated circuit (ASIC), a controller, another hardware device, firmware device, or any combination thereof. As an example, the method of FIG. 5 can be initiated by fabrication equipment, such as a processor within or coupled to fabrication equipment and that executes instructions stored at a memory (e.g., a non-transitory computer-readable medium), as described further with reference to FIG. 7.

An electronic device formed according to the method 500 may include a varying thickness spiral inductor that provides a similar inductance as compared to a uniform thickness spiral inductor of similar dimensions. However, a reduced thickness of an innermost turn of the varying thickness spiral inductor causes the varying thickness inductor to have a lower electrical resistance due to reduced eddy current loss. Thus, an electronic device may use the varying thickness inductor to provide inductance using less power, as compared to an electronic device that includes the uniform thickness spiral inductor.

Figure 6:
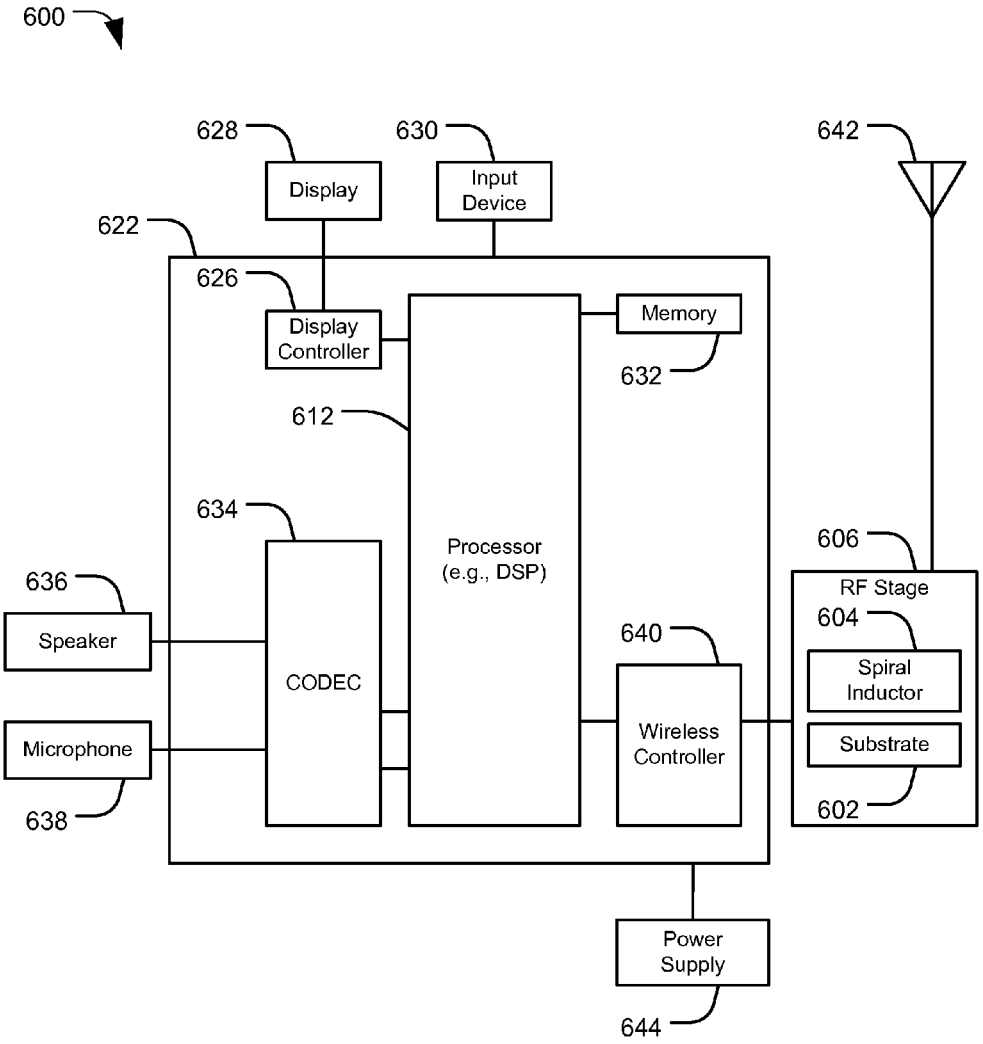
FIG. 6 is a block diagram that illustrates a communication device including a substrate and a spiral inductor having a thickness that varies.

Referring to FIG. 6, a block diagram depicts a particular illustrative embodiment of a mobile device that includes a substrate 602 and a spiral inductor 604, the mobile device generally designated 600. The mobile device 600, or components thereof, may include, implement, or be included within a device such as: a communications device, a mobile phone, a cellular phone, a computer, a portable computer, a tablet, an access point, a set top box, an entertainment unit, a navigation device, a personal digital assistant (PDA), a fixed location data unit, a mobile location data unit, a desktop computer, a monitor, a computer monitor, a television, a tuner, a radio, a satellite radio, a music player, a digital music player, a portable music player, a video player, a digital video player, a digital video disc (DVD) player, or a portable digital video player.

The mobile device 600 may include a processor 612, such as a digital signal processor (DSP). The processor 612 may be coupled to a memory 632 (e.g., a non-transitory computer-readable medium).

FIG. 6 also shows a display controller 626 that is coupled to the processor 612 and to a display 628. A coder/decoder (CODEC) 634 can also be coupled to the processor 612. A speaker 636 and a microphone 638 can be coupled to the CODEC 634. A wireless controller 640 can be coupled to the processor 612 and can be further coupled to a radio frequency (RF) stage 606 that includes the substrate 602 and the spiral inductor 604. The RF stage 606 may be coupled to an antenna 642. In other embodiments, the substrate 602 and the spiral inductor 604 may be included in, or configured to provide inductance to, other components of the mobile device 600. The substrate 602 and the spiral inductor 604 may be included in a LC voltage controlled oscillator (LC-VCO), an LC-based filter, a matching circuit, or another component of the RF stage 606.

In a particular embodiment, the spiral inductor 604 is coupled to (e.g., deposited above) the substrate 602. The spiral inductor 604 may include a first conductive spiral and a second conductive spiral overlaying the first conductive spiral. A first portion of an innermost turn of the spiral inductor 604 may have a first thickness in a direction perpendicular to the substrate 602. The first portion of the innermost turn may include a first portion of the first conductive spiral (and not include the second conductive spiral). A second portion of the innermost turn may include a first portion of the second conductive spiral. A portion of an outermost turn of the spiral inductor 604 may have a second thickness in the direction perpendicular to the substrate that is greater than the first thickness. A portion of the outermost turn may include a second portion of the first conductive spiral and a second portion of the second conductive spiral. For example, the substrate 602 may correspond to the substrate 102 of FIG. 1, and the spiral inductor 604 may correspond to the spiral inductor 104 of FIG. 1 or the varying thickness spiral inductor 304 of FIG. 3.

In another particular embodiment, the spiral inductor 604 is coupled to (e.g., deposited above) the substrate 602. A first portion of an innermost turn of the spiral inductor 604 may have a first thickness in a direction perpendicular to the substrate 602. A second portion of the innermost turn of the spiral inductor 604 may have a second thickness, in the direction perpendicular to the substrate, that is greater than the first thickness. A thickness of the spiral inductor 604 in the direction perpendicular to the substrate 602 may increase according to a gradient from the first thickness to the second thickness. For example, the substrate 602 may correspond to the substrate 202 of FIG. 2, and the spiral inductor 604 may correspond to the spiral inductor 204 of FIG. 2.

In a particular embodiment, the processor 612, the display controller 626, the memory 632, the CODEC 634, and the wireless controller 640 are included in a system-in-package or system-on-chip device 622. An input device 630 and a power supply 644 may be coupled to the system-on-chip device 622. Moreover, in a particular embodiment, and as illustrated in FIG. 6, the RF stage 606, the display 628, the input device 630, the speaker 636, the microphone 638, the antenna 642, and the power supply 644 are external to the system-on-chip device 622. However, each of the RF stage 606, the display 628, the input device 630, the speaker 636, the microphone 638, the antenna 642, and the power supply 644 can be coupled to a component of the system-on-chip device 622, such as an interface or a controller. The RF stage 606 may be included in the system-on-chip device 622 or may be a separate component, as shown in FIG. 6.

In a particular embodiment, an apparatus (such as the mobile device 600) includes means for storing energy in a magnetic field (e.g., the spiral inductor 104 of FIG. 1, the varying thickness spiral inductor 304 of FIG. 3, or the spiral inductor 604 of FIG. 6) coupled to means for supporting layers (e.g., the substrate 102 of FIG. 1 or the substrate 602 of FIG. 6) and having a spiral shape. The means for storing energy may include a first conductive spiral and a second conductive spiral overlaying the first conductive spiral. A portion of an innermost turn of the means for storing energy may have a first thickness in a direction perpendicular to the means for supporting layers. The first portion of the innermost turn may include a first portion of the first conductive spiral and may not include the second conductive spiral. A second portion of the innermost turn may include a first portion of the second conductive spiral. A portion of an outermost turn of the means for storing energy may have a second thickness in the direction perpendicular to the substrate that is greater than the first thickness. A portion of the outermost turn may include a second portion of the first conductive spiral and a second portion of the second conductive spiral. For example, the means for supporting layers may include or correspond to the substrate 102 of FIG. 1 or the substrate 602 of FIG. 6, and the means for storing energy may include or correspond to the spiral inductor 104 of FIG. 1, the varying thickness spiral inductor 304 of FIG. 3, or the spiral inductor 604 of FIG. 6. The first conductive spiral may include or correspond to the second conductive spiral 110 or the conductive layer 108 of FIG. 1. The second conductive spiral may include or correspond to the conductive layer 108 or the first conductive spiral 106 of FIG. 1. The first portion of the innermost turn may include or correspond to the first portion 120 or the second portion 122 of FIG. 1. The second portion of the innermost turn may correspond to the second portion 122 or the third portion 126 of FIG. 1. The portion of the outermost turn may include or correspond to the fourth portion 124 of FIG. 1.

In another particular embodiment, an apparatus (such as the mobile device 600) includes means for storing energy in a magnetic field (e.g., the spiral inductor 204 of FIG. 2 or the spiral inductor 604 of FIG. 6) coupled to means for supporting layers (e.g., the substrate 202 of FIG. 2 or the substrate 602 of FIG. 6) and having a spiral shape. A portion of an innermost turn of the means for storing energy may have a first thickness in a direction perpendicular to the means for supporting layers, and a portion of an outermost turn of the means for storing energy may have a second thickness that is greater than the first thickness in the direction perpendicular to the means for supporting layers. For example, the means for supporting layers may include or correspond to the substrate 202 of FIG. 2 or the substrate 602 of FIG. 6, and the means for storing energy may include or correspond to the spiral inductor 204 of FIG. 2 or the spiral inductor 604 of FIG. 6. The first portion of the innermost turn may include or correspond to the first point 214 of FIG. 2, and the second portion of the innermost turn may include or correspond to the second point 212 of FIG. 2.

Figure 7:
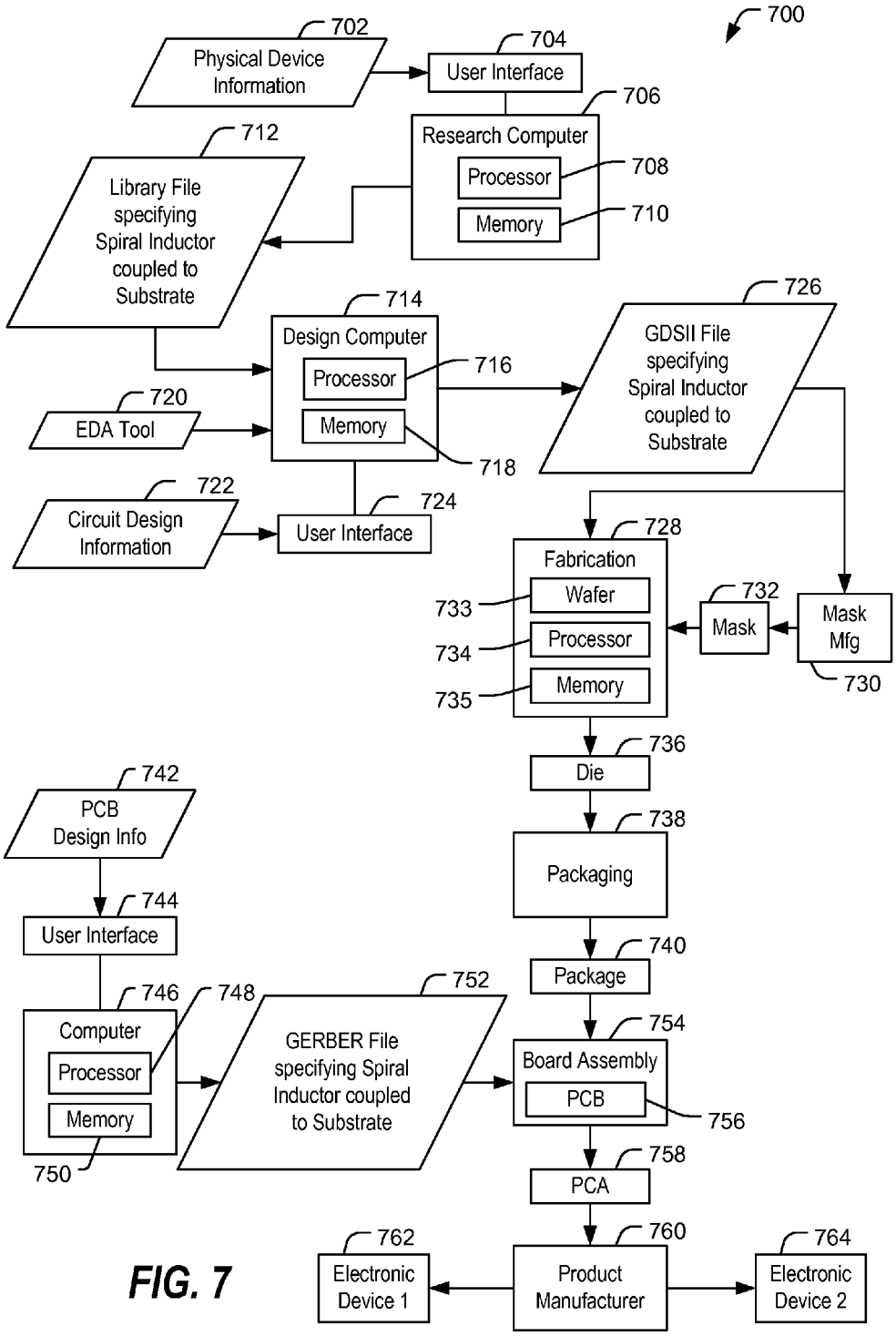
FIG. 7 is a data flow diagram that illustrates a particular illustrative embodiment of a manufacturing process to manufacture electronic devices that include a substrate and a spiral inductor having a thickness that varies.

The foregoing disclosed devices and functionalities may be designed and configured into computer files (e.g. RTL, GDSII, GERBER, etc.) stored on computer-readable media. Some or all such files may be provided to fabrication handlers to fabricate devices based on such files. Resulting products include wafers that are then cut into dies and packaged into chips. The chips are then employed in devices described above. FIG. 7 depicts a particular illustrative embodiment of an electronic device manufacturing process 700.

Physical device information 702 is received at the manufacturing process 700, such as at a research computer 706. The physical device information 702 may include design information representing at least one physical property of an electronic device, such as a spiral inductor (e.g., corresponding to the spiral inductor 104 of FIG. 1 or the spiral inductor 204 of FIG. 2) coupled to a substrate (e.g., corresponding to the substrate 102 of FIG. 1 or the substrate 202 of FIG. 2). For example, the physical device information 702 may include physical parameters, material characteristics, and structure information that is entered via a user interface 704 coupled to the research computer 706. The research computer 706 includes a processor 708, such as one or more processing cores, coupled to a computer-readable medium such as a memory 710. The memory 710 may store computer-readable instructions that are executable to cause the processor 708 to transform the physical device information 702 to comply with a file format and to generate a library file 712.

In a particular embodiment, the library file 712 includes at least one data file including the transformed design information. For example, the library file 712 may include a library of electronic devices (e.g., semiconductor devices), including a spiral inductor (e.g., corresponding to the spiral inductor 104 of FIG. 1 or the spiral inductor 204 of FIG. 2) coupled to a substrate (e.g., corresponding to the substrate 102 of FIG. 1 or the substrate 202 of FIG. 2), provided for use with an electronic design automation (EDA) tool 720.

The library file 712 may be used in conjunction with the EDA tool 720 at a design computer 714 including a processor 716, such as one or more processing cores, coupled to a memory 718. The EDA tool 720 may be stored as processor executable instructions at the memory 718 to enable a user of the design computer 714 to design a circuit including a spiral inductor (e.g., corresponding to the spiral inductor 104 of FIG. 1 or the spiral inductor 204 of FIG. 2) coupled to a substrate (e.g., corresponding to the substrate 102 of FIG. 1 or the substrate 202 of FIG. 2), using the library file 712. For example, a user of the design computer 714 may enter circuit design information 722 via a user interface 724 coupled to the design computer 714. The circuit design information 722 may include design information representing at least one physical property of an electronic device, such as a spiral inductor (e.g., corresponding to the spiral inductor 104 of FIG. 1 or the spiral inductor 204 of FIG. 2) coupled to a substrate (e.g., corresponding to the substrate 102 of FIG. 1 or the substrate 202 of FIG. 2). To illustrate, the circuit design property may include identification of particular circuits and relationships to other elements in a circuit design, positioning information, feature size information, interconnection information, or other information representing a physical property of an electronic device.

The design computer 714 may be configured to transform the design information, including the circuit design information 722, to comply with a file format. To illustrate, the file formation may include a database binary file format representing planar geometric shapes, text labels, and other information about a circuit layout in a hierarchical format, such as a Graphic Data System (GDSII) file format. The design computer 714 may be configured to generate a data file including the transformed design information, such as a GDSII file 726 that includes information describing a spiral inductor (e.g., corresponding to the spiral inductor 104 of FIG. 1 or the spiral inductor 204 of FIG. 2) coupled to a substrate (e.g., corresponding to the substrate 102 of FIG. 1 or the substrate 202 of FIG. 2), in addition to other circuits or information. To illustrate, the data file may include information corresponding to a system-on-chip (SOC) or a chip interposer component that that includes a spiral inductor (e.g., corresponding to the spiral inductor 104 of FIG. 1 or the spiral inductor 204 of FIG. 2) coupled to a substrate (e.g., corresponding to the substrate 102 of FIG. 1 or the substrate 202 of FIG. 2), and that also includes additional electronic circuits and components within the SOC.

The GDSII file 726 may be received at a fabrication process 728 to manufacture a spiral inductor (e.g., corresponding to the spiral inductor 104 of FIG. 1 or the spiral inductor 204 of FIG. 2) coupled to a substrate (e.g., corresponding to the substrate 102 of FIG. 1 or the substrate 202 of FIG. 2) according to transformed information in the GDSII file 726. For example, a device manufacture process may include providing the GDSII file 726 to a mask manufacturer 730 to create one or more masks, such as masks to be used with photolithography processing, illustrated in FIG. 7 as a representative mask 732. The mask 732 may be used during the fabrication process to generate one or more wafers 733, which may be tested and separated into dies, such as a representative die 736. The die 736 includes a circuit including a spiral inductor (e.g., corresponding to the spiral inductor 104 of FIG. 1 or the spiral inductor 204 of FIG. 2) coupled to a substrate (e.g., corresponding to the substrate 102 of FIG. 1 or the substrate 202 of FIG. 2).

In a particular embodiment, the fabrication process 728 may be initiated by or controlled by a processor 734. The processor 734 may access a memory 735 that includes executable instructions such as computer-readable instructions or processor-readable instructions. The executable instructions may include one or more instructions that are executable by a computer, such as the processor 734.

The fabrication process 728 may be implemented by a fabrication system that is fully automated or partially automated. For example, the fabrication process 728 may be automated and may perform processing steps according to a schedule. The fabrication system may include fabrication equipment (e.g., processing tools) to perform one or more operations to form an electronic device. For example, the fabrication equipment may be configured to form one or more conductive spirals, to form one or more conductive layers, to form one or more passivation layers, to form one or more conductive vias, to perform one or more etches, to form one or more metal structures, or to form other integrated circuit elements using integrated circuit manufacturing processes (e.g., wet etching, dry etching, deposition, planarization, lithography, or a combination thereof).

The fabrication system may have a distributed architecture (e.g., a hierarchy). For example, the fabrication system may include one or more processors, such as the processor 734, one or more memories, such as the memory 735, and/or controllers that are distributed according to the distributed architecture. The distributed architecture may include a high-level processor that controls or initiates operations of one or more low-level systems. For example, a high-level portion of the fabrication process 728 may include one or more processors, such as the processor 734, and the low-level systems may each include or may be controlled by one or more corresponding controllers. A particular controller of a particular low-level system may receive one or more instructions (e.g., commands) from a high-level system, may issue sub-commands to subordinate modules or process tools, and may communicate status data back to the high-level system. Each of the one or more low-level systems may be associated with one or more corresponding pieces of fabrication equipment (e.g., processing tools). In a particular embodiment, the fabrication system may include multiple processors that are distributed in the fabrication system. For example, a controller of a low-level system component of the fabrication system may include a processor, such as the processor 734.

Alternatively, the processor 734 may be a part of a high-level system, subsystem, or component of the fabrication system. In another embodiment, the processor 734 includes distributed processing at various levels and components of a fabrication system.

Thus, the memory 735 may include processor-executable instructions that, when executed by the processor 734, cause the processor 734 to initiate or control formation of a first conductive spiral of a spiral inductor coupled to a substrate. For example, a first conductive layer including the first conductive spiral may be formed by one or more deposition tools, such as a flowable chemical vapor deposition (FCVD) tool or a spin-on deposition tool. The first conductive spiral may be etched from the first conductive layer by one or more etching machines or etchers, such as a wet etcher, a dry etcher, or a plasma etcher. Execution of the processor-executable instructions may further cause the processor 734 to initiate or control formation of a second conductive spiral of the spiral inductor. For example, a second conductive layer including the second conductive spiral may be formed by one or more deposition tools, such as a flowable chemical vapor deposition (FCVD) tool or a spin-on deposition tool. The second conductive spiral may be etched from the second conductive layer by one or more etching machines or etchers, such as a wet etcher, a dry etcher, or a plasma etcher. The second conductive spiral may overlay the first conductive spiral. A first portion of an innermost turn of the spiral inductor may have a first thickness in a direction perpendicular to the substrate. The first portion of the innermost turn may include a first portion of the first conductive spiral and may not include the second conductive spiral. A second portion of the innermost turn may include a first portion of the second conductive spiral. A portion of an outermost turn of the spiral inductor may have a second thickness in the direction perpendicular to the substrate. The second thickness may be greater than the first thickness. The portion of the outermost turn may include a second portion of the first conductive spiral and a second portion of the second conductive spiral.

Further, the memory 735 may include processor-executable instructions that, when executed by the processor 734, cause the processor 734 to initiate or control formation of a conductive spiral of a spiral inductor coupled to a substrate. For example, a first conductive layer including the conductive spiral may be formed by one or more deposition tools, such as a flowable chemical vapor deposition (FCVD) tool or a spin-on deposition tool. The conductive spiral may be etched from the first conductive layer by one or more etching machines or etchers, such as a wet etcher, a dry etcher, or a plasma etcher. Execution of the processor-executable instructions may further cause the processor 734 to initiate or control formation of a conductive layer of the spiral inductor above the conductive spiral. For example, a second conductive layer including the conductive layer may be formed by one or more deposition tools, such as a flowable chemical vapor deposition (FCVD) tool or a spin-on deposition tool. The conductive layer may be etched from the second conductive layer by one or more etching machines or etchers, such as a wet etcher, a dry etcher, or a plasma etcher. A first portion of an innermost turn of the spiral inductor may have a first thickness in a direction perpendicular to the substrate. A second portion of the innermost turn may have a second thickness in the direction perpendicular to the substrate. The second thickness may be greater than the first thickness. A thickness of the spiral inductor may increase according to a gradient from the first thickness to the second thickness.

As an illustrative example, the processor 734 may control a step for forming a first conductive spiral of a spiral inductor coupled to a substrate. For example, the processor 734 may be embedded in or coupled to one or more controllers that control one or more pieces of fabrication equipment to perform the step for forming the first conductive spiral of the spiral inductor coupled to the substrate. The processor 734 may control the step for forming the first conductive spiral by controlling formation of the first conductive spiral, by controlling one or more other processes configured to form the first conductive spiral, or any combination thereof. The processor 734 may also control a step for forming a second conductive spiral of the spiral inductor. The processor 734 may control the step for forming the second conductive spiral by controlling formation of the second conductive spiral, by controlling one or more other processes configured to form the second conductive spiral, or any combination thereof. The second spiral may overlay the first conductive spiral. A first portion of an innermost turn of the spiral inductor may have a first thickness in a direction perpendicular to the substrate. The first portion of the innermost turn may include a first portion of the first conductive spiral and may not include the second conductive spiral. A second portion of the innermost turn may include a first portion of the second conductive spiral. A portion of an outermost turn of the spiral inductor may have a second thickness in the direction perpendicular to the substrate. The second thickness may be greater than the first thickness. The portion of the outermost turn may include a second portion of the first conductive spiral and a second portion of the second conductive spiral. Integrated circuit manufacturing processes may be used to fabricate the first conductive spiral and the second conductive spiral (e.g., wet etching, dry etching, deposition, planarization, lithography, or a combination thereof).

As another illustrative example, the processor 734 may control a step for forming a conductive spiral of a spiral inductor coupled to a substrate. For example, the processor 734 may be embedded in or coupled to one or more controllers that control one or more pieces of fabrication equipment to perform the step for forming the conductive spiral of the spiral inductor coupled to the substrate. The processor 734 may control the step for forming the conductive spiral by controlling formation of the conductive spiral, by controlling one or more other processes configured to form the conductive spiral, or any combination thereof. The processor 734 may also control a step for forming a conductive layer of the spiral inductor above the conductive spiral. The processor 734 may control the step for forming the conductive layer by controlling formation of the conductive layer, by controlling one or more other processes configured to form the conductive layer, or any combination thereof. A first portion of an innermost turn of the spiral inductor may have a first thickness in a direction perpendicular to the substrate. A second portion of the innermost turn may have a second thickness in the direction perpendicular to the substrate. The second thickness may be greater than the first thickness. A thickness of the spiral inductor may increase according to a gradient from the first thickness to the second thickness. Integrated circuit manufacturing processes may be used to fabricate the conductive spiral and the conductive layer (e.g., wet etching, dry etching, deposition, planarization, lithography, or a combination thereof).

The die 736 may be provided to a packaging process 738 where the die 736 is incorporated into a representative package 740. For example, the package 740 may include the single die 736 or multiple dies, such as a system-in-package (SiP) arrangement. The package 740 may be configured to conform to one or more standards or specifications, such as Joint Electron Device Engineering Council (JEDEC) standards.

Information regarding the package 740 may be distributed to various product designers, such as via a component library stored at a computer 746. The computer 746 may include a processor 748, such as one or more processing cores, coupled to a memory 750. A printed circuit board (PCB) tool may be stored as processor executable instructions at the memory 750 to process PCB design information 742 received from a user of the computer 746 via a user interface 744. The PCB design information 742 may include physical positioning information of a packaged electronic device on a circuit board, the packaged electronic device corresponding to the package 740 including a spiral inductor (e.g., corresponding to the spiral inductor 104 of FIG. 1 or the spiral inductor 204 of FIG. 2) coupled to a substrate (e.g., corresponding to the substrate 102 of FIG. 1 or the substrate 202 of FIG. 2).

The computer 746 may be configured to transform the PCB design information 742 to generate a data file, such as a GERBER file 752 with data that includes physical positioning information of a packaged electronic device on a circuit board, as well as layout of electrical connections such as traces and vias, where the packaged electronic device corresponds to the package 740 including a spiral inductor (e.g., corresponding to the spiral inductor 104 of FIG. 1 or the spiral inductor 204 of FIG. 2) coupled to a substrate (e.g., corresponding to the substrate 102 of FIG. 1 or the substrate 202 of FIG. 2). In other embodiments, the data file generated by the transformed PCB design information may have a format other than a GERBER format.

The GERBER file 752 may be received at a board assembly process 754 and used to create PCBs, such as a representative PCB 756, manufactured in accordance with the design information stored within the GERBER file 752. For example, the GERBER file 752 may be uploaded to one or more machines to perform various steps of a PCB production process. The PCB 756 may be populated with electronic components including the package 740 to form a representative printed circuit assembly (PCA) 758.

The PCA 758 may be received at a product manufacturer 760 and integrated into one or more electronic devices, such as a first representative electronic device 762 and a second representative electronic device 764. As an illustrative, non-limiting example, the first representative electronic device 762, the second representative electronic device 764, or both, may be selected from a set top box, a music player, a video player, an entertainment unit, a navigation device, a communications device, a personal digital assistant (PDA), a fixed location data unit, and a computer, into which a spiral inductor (e.g., corresponding to the spiral inductor 104 of FIG. 1 or the spiral inductor 204 of FIG. 2) coupled to a substrate (e.g., corresponding to the substrate 102 of FIG. 1 or the substrate 202 of FIG. 2), is integrated. As another illustrative, non-limiting example, one or more of the electronic devices 762 and 764 may be remote units such as mobile phones, hand-held personal communication systems (PCS) units, portable data units such as personal data assistants, global positioning system (GPS) enabled devices, navigation devices, fixed location data units such as meter reading equipment, or any other device that stores or retrieves data or computer instructions, or any combination thereof. Although FIG. 7 illustrates remote units according to teachings of the disclosure, the disclosure is not limited to these illustrated units. Embodiments of the disclosure may be suitably employed in any device which includes active integrated circuitry including memory and on-chip circuitry.

A device that includes a spiral inductor (e.g., corresponding to the spiral inductor 104 of FIG. 1 or the spiral inductor 204 of FIG. 2) coupled to a substrate (e.g., corresponding to the substrate 102 of FIG. 1 or the substrate 202 of FIG. 2), may be fabricated, processed, and incorporated into an electronic device, as described in the illustrative manufacturing process 700. One or more aspects of the embodiments disclosed with respect to FIGS. 1-6 may be included at various processing stages, such as within the library file 712, the GDSII file 726, and the GERBER file 752, as well as stored at the memory 710 of the research computer 706, the memory 718 of the design computer 714, the memory 750 of the computer 746, the memory of one or more other computers or processors (not shown) used at the various stages, such as at the board assembly process 754, and also incorporated into one or more other physical embodiments such as the mask 732, the die 736, the package 740, the PCA 758, other products such as prototype circuits or devices (not shown), or any combination thereof. Although various representative stages are depicted with reference to FIGS. 1-6, in other embodiments fewer stages may be used or additional stages may be included. Similarly, the process 700 of FIG. 7 may be performed by a single entity or by one or more entities performing various stages of the manufacturing process 700.

In conjunction with the described embodiments, a non-transitory computer-readable medium stores instructions that, when executed by a processor, cause the processor to initiate formation of a first conductive spiral of a spiral inductor coupled to a substrate. The non-transitory computer readable medium may further store instructions that, when executed by the processor, cause the processor to initiate formation of a second conductive spiral of the spiral inductor. The second conductive spiral may overlay the first conductive spiral. A first portion of an innermost turn of the spiral inductor may have a first thickness in a direction perpendicular to the substrate. The first portion of the innermost turn may include a first portion of the first conductive spiral and may not include the second conductive spiral. A second portion of the innermost turn may include a first portion of the second conductive spiral. A portion of an outermost turn of the spiral inductor may have a second thickness in the direction perpendicular to the substrate. The second thickness may be greater than the first thickness. The portion of the outermost turn may include a second portion of the first conductive spiral and a second portion of the second conductive spiral. The non-transitory computer-readable medium may correspond to the memory 632 of FIG. 6 or to the memory 710, the memory 718, or the memory 750 of FIG. 7. The processor may correspond to the processor 612 of FIG. 6 or to the processor 708, the processor 716, or the processor 748 of FIG. 7. The substrate may correspond to the substrate 102 of FIG. 1, the substrate 202 of FIG. 2, or the substrate 602 of FIG. 6. The spiral inductor may correspond to the spiral inductor 104 of FIG. 1, the spiral inductor 204 of FIG. 2, the varying thickness spiral inductor 304 of FIG. 3, or the spiral inductor 604 of FIG. 6. The first conductive spiral may correspond to the conductive layer 108 or the second conductive spiral 110 of FIG. 1 or to the conductive layer 208 or the second conductive spiral 210 of FIG. 2. The second conductive spiral may correspond to the first conductive spiral 106 or the conductive layer 108 of FIG. 1 or to the first conductive spiral 206 or the conductive layer 208 of FIG. 2.

In conjunction with the described embodiments, a non-transitory computer-readable medium stores instructions that, when executed by a processor, cause the processor to initiate formation of a conductive spiral of a spiral inductor coupled to a substrate. The non-transitory computer readable medium may further store instructions that, when executed by the processor, cause the processor to form a conductive layer of the spiral inductor above the conductive spiral. A first portion of an innermost turn of the spiral inductor may have a first thickness in a direction perpendicular to the substrate. A second portion of the innermost turn may have a second thickness in the direction perpendicular to the substrate. The second thickness may be greater than the first thickness. A thickness of the spiral inductor may increase according to a gradient from the first thickness to the second thickness. The non-transitory computer-readable medium may correspond to the memory 710, the memory 718, or the memory 750 of FIG. 7. The processor may correspond to the processor 708, the processor 716, the processor 734, or the processor 748 of FIG. 7. The substrate may correspond to the substrate 202 of FIG. 2 or the substrate 602 of FIG. 6. The spiral inductor may correspond to the spiral inductor 204 of FIG. 2, or the spiral inductor 604 of FIG. 6. The conductive spiral may correspond to the conductive layer 208 or the second conductive spiral 210 of FIG. 2. The conductive layer may correspond to the first conductive spiral 206 or the conductive layer 208 of FIG. 2.

Those of skill would further appreciate that the various illustrative logical blocks, configurations, modules, circuits, and algorithm steps described in connection with the embodiments disclosed herein may be implemented as electronic hardware, computer software executed by a processor, or combinations of both. Various illustrative components, blocks, configurations, modules, circuits, and steps have been described above generally in terms of their functionality. Whether such functionality is implemented as hardware or processor executable instructions depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the embodiments disclosed herein may be embodied directly in hardware, in a software module executed by a processor, or in a combination of the two. A software module may reside in memory, such as random access memory (RAM), flash memory, read-only memory (ROM), programmable read-only memory (PROM), erasable programmable read-only memory (EPROM), electrically erasable programmable read-only memory (EEPROM), registers, hard disk, a removable disk, a compact disc read-only memory (CD-ROM). The memory may include any form of non-transient storage medium known in the art. An exemplary storage medium (e.g., memory) is coupled to the processor such that the processor can read information from, and write information to, the storage medium. In the alternative, the storage medium may be integral to the processor. The processor and the storage medium may reside in an application-specific integrated circuit (ASIC). The ASIC may reside in a computing device or a user terminal. In the alternative, the processor and the storage medium may reside as discrete components in a computing device or user terminal.

The previous description of the disclosed embodiments is provided to enable a person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as defined by the following claims.

What is claimed is:

1. An apparatus comprising:

a substrate; and a spiral inductor coupled to the substrate, the spiral inductor comprising a first conductive spiral defining a first coil and a second conductive spiral defining a second coil and overlaying the first conductive spiral, the spiral inductor further comprising a passivation layer including a first portion between the first conductive spiral and the second conductive spiral, the spiral inductor including:

a first portion of an innermost turn having a first thickness in a direction perpendicular to the substrate, the first portion of the innermost turn including a first portion of the first conductive spiral and not including the second conductive spiral, a second portion of the innermost turn including a second portion of the first conductive spiral and a second portion of the passivation layer overlaying the second portion of the first conductive spiral, the second portion of the innermost turn not including the second conductive spiral, and a portion of an outermost turn of the spiral inductor having a second thickness in the direction perpendicular to the substrate, wherein the second thickness is greater than the first thickness, and the portion of the outermost turn including a third portion of the first conductive spiral and a second portion of the second conductive spiral.

2. The apparatus of claim 1, wherein a first length of the first conductive spiral is greater than a second length of the second conductive spiral.

3. The apparatus of claim 1, wherein the spiral inductor further comprises a conductive layer, wherein a third portion of the innermost turn of the spiral inductor has a third thickness in the direction perpendicular to the substrate, wherein the third thickness is less than the second thickness and greater than the first thickness, wherein the third portion of the innermost turn includes a third portion of the first conductive spiral, the conductive layer, and the second conductive spiral.

4. The apparatus of claim 3, wherein the first portion of the innermost turn does not include the conductive layer.

5. The apparatus of claim 3, wherein the portion of the outermost turn of the spiral inductor includes the conductive layer.

6. The apparatus of claim 3, wherein the conductive layer comprises a discontinuous spiral.

7. The apparatus of claim 3, wherein the conductive layer comprises an input lead, an output lead, or a combination thereof.

8. The apparatus of claim 1, wherein the first conductive spiral is electrically connected to the second conductive spiral by a via that extends through a portion of the passivation layer.

9. The apparatus of claim 3, wherein a thickness of the innermost turn in the direction perpendicular to the substrate monotonically increases from the first portion of the innermost turn to the second portion of the innermost turn.

10. The apparatus of claim 1, wherein the substrate is a dielectric substrate formed of a glass material, an alkaline earth boro-aluminosilicate glass, Silicon (Si), Gallium Arsenide (GaAs), Indium Phosphate (InP), Silicon Carbide (SiC), a glass-based laminate, sapphire ($Al_2O_3$), quartz, a ceramic, Silicon on Insulator (SOI), Silicon on Sapphire (SOS), high resistivity Silicon (HRS), Aluminum Nitride (AlN), a plastic, or a combination thereof.

11. The apparatus of claim 1, wherein the spiral inductor is formed of aluminum, copper, silver, gold, tungsten, molybdenum, an alloy of aluminum, silver, gold, tungsten, or molybdenum, or a combination thereof.

12. The apparatus of claim 1, wherein the spiral inductor is a stepped layer stack inductor.

13. The apparatus of claim 1, wherein a trace width associated with the spiral inductor is a minimum trace width that can be manufactured using a particular process technology used to fabricate the spiral inductor.

14. The apparatus of claim 1, integrated in at least one die.

15. The apparatus of claim 1, further comprising a device selected from a mobile phone, a tablet, a set top box, a music player, a video player, an entertainment unit, a navigation device, a communications device, a personal digital assistant (PDA), a fixed location data unit, and a computer, into which the substrate and the spiral inductor are integrated.

16. An apparatus comprising:

a substrate; and a spiral inductor coupled to the substrate and including a first conductive spiral defining a first coil and a second conductive spiral defining a second coil and overlaying the first conductive spiral, the spiral inductor further including:

a conductive layer including a first portion between the first conductive spiral and the second conductive spiral and a second portion overlaying the first conductive spiral, a first portion of an innermost turn having a first thickness in a direction perpendicular to the substrate, and a second portion of the innermost turn having a second thickness in the direction perpendicular to the substrate, wherein the second thickness is greater than the first thickness, wherein a thickness of the second portion of the conductive layer in the direction perpendicular to the substrate increases according to a gradient from the first thickness to the second thickness.

17. The apparatus of claim 16, wherein a portion of an outermost turn of the spiral inductor has a third thickness in the direction perpendicular to the substrate, wherein the third thickness is greater than the first thickness.

18. The apparatus of claim 17, wherein the thickness of the spiral inductor monotonically increases from the first thickness to the third thickness.

19. The apparatus of claim 16, wherein the spiral inductor is a gradient layer stack inductor.

20. The apparatus of claim 16, integrated in at least one die.

21. The apparatus of claim 16, further comprising a device selected from a mobile phone, a tablet, a set top box, a music player, a video player, an entertainment unit, a navigation device, a communications device, a personal digital assistant (PDA), a fixed location data unit, and a computer, into which the substrate and the spiral inductor are integrated.

22. The apparatus of claim 1, wherein the spiral inductor further includes multiple passivation layers including the passivation layer and includes a conductive layer between the first portion of the passivation layer and a second passivation layer of the multiple passivation layers, the multiple passivation layers between the first conductive spiral and the second conductive spiral.

23. The apparatus of claim 1, wherein the spiral inductor comprises a spirangle inductor.

24. The apparatus of claim 16, wherein the second portion of the conductive layer is not between the first conductive spiral and the second conductive spiral.

25. The apparatus of claim 16, wherein the second portion of the innermost turn includes the second portion of the conductive layer.

* * * * *